US011313178B2

(12) United States Patent
Tiwari

(10) Patent No.: US 11,313,178 B2
(45) Date of Patent: Apr. 26, 2022

(54) CONCEALED NOZZLE DRILL BIT

(71) Applicant: Saudi Arabian Oil Company, Dhahran (SA)

(72) Inventor: Shrikant Tiwari, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 106 days.

(21) Appl. No.: 16/857,738

(22) Filed: Apr. 24, 2020

(65) Prior Publication Data

US 2021/0332647 A1 Oct. 28, 2021

(51) Int. Cl.
*E21B 10/61* (2006.01)
*E21B 10/60* (2006.01)
*E21B 10/18* (2006.01)

(52) U.S. Cl.
CPC ..... *E21B 10/61* (2013.01); *E21B 10/18* (2013.01); *E21B 10/602* (2013.01)

(58) Field of Classification Search
CPC ..... E21B 10/61
See application file for complete search history.

(56) References Cited

U.S. PATENT DOCUMENTS

| | | | | |
|---|---|---|---|---|
| 2,987,130 A | | 6/1961 | Mcintyre | |
| 3,189,107 A | | 6/1965 | Galle | |
| 3,195,660 A | | 7/1965 | Mckown | |
| 3,509,952 A | | 5/1970 | Galle | |
| 3,645,331 A | | 2/1972 | Maurer et al. | |
| 3,645,346 A | * | 2/1972 | Miller | E21B 7/18 175/237 |
| 4,630,691 A | | 12/1986 | Hooper | |
| 5,934,389 A | * | 8/1999 | Ramsey | E21B 10/18 175/57 |
| 6,098,728 A | | 8/2000 | Wells et al. | |
| 6,227,316 B1 | * | 5/2001 | Rohde | E21B 10/18 175/340 |

(Continued)

FOREIGN PATENT DOCUMENTS

| | | |
|---|---|---|
| CN | 101509352 A | 8/2009 |
| GB | 2434389 A | 7/2007 |
| WO | 2019002436 A1 | 1/2019 |

OTHER PUBLICATIONS

Schlumberger Oilfield Glossary entry for "circulation system", accessed Oct. 5, 2021 via glossary.oilfield.slb.com.*

(Continued)

*Primary Examiner* — Blake Michener
(74) *Attorney, Agent, or Firm* — Bracewell LLP; Constance G. Rhebergen; Linda L. Morgan

(57) ABSTRACT

Systems and methods for drilling a subterranean well with a drill bit include a drill bit body with a central bore. A plurality of ports extend through the nose end of the drill bit body from the central bore to an outside of the drill bit body. A blocked nozzle is located within one of the plurality of ports. The blocked nozzle has a nozzle bore end and a nozzle nose end opposite the nozzle bore end. A bore end disk is located at the nozzle bore end of the blocked nozzle, preventing a flow of fluids through the blocked nozzle past the bore end disk. A nose end disk is located at the nozzle nose end of the blocked nozzle, preventing the flow of fluids through the blocked nozzle past the nose end disk. The nose end disk and the bore end disk are removable.

16 Claims, 5 Drawing Sheets

(56) References Cited

U.S. PATENT DOCUMENTS

| | | | | |
|---|---|---|---|---|
| 7,007,865 | B2 | 3/2006 | Dodd | |
| 8,074,749 | B2 | 12/2011 | Twardowski et al. | |
| 8,297,364 | B2 * | 10/2012 | Agrawal | E21B 34/063 166/376 |
| 8,631,876 | B2 * | 1/2014 | Xu | B22F 5/00 166/376 |
| 9,228,421 | B2 * | 1/2016 | Kent | E21B 34/063 |
| 9,243,475 | B2 * | 1/2016 | Xu | E21B 41/00 |
| 9,309,726 | B2 | 4/2016 | Tahoun et al. | |
| 10,323,464 | B1 | 6/2019 | Al-Abduljabbar | |
| 2005/0274545 | A1 * | 12/2005 | Mesa-Wilmot | E21B 21/08 175/57 |
| 2010/0147594 | A1 | 6/2010 | Ben et al. | |

OTHER PUBLICATIONS

International Search Report and Written Opinion for PCT Application No. PCT/US2021/028714 dated Aug. 2, 2021.

* cited by examiner

CONCEALED NOZZLE DRILL BIT

BACKGROUND OF THE DISCLOSURE

1. Field of the Disclosure

The present disclosure relates to bits for drilling subterranean wells, and more particularly to nozzles used in such bits.

2. Description of the Related Art

Drill bits can be used for drilling subterranean wells, such as hydrocarbon production wells, water wells, injection wells, disposal wells, test wells, exploratory wells or observation wells. The drill bits can be attached at an end of a drill string and rotated. As the drill bit rotates, the drill bit can cut, shear, or fracture the earth and rock formations to drill a bore and form the subterranean well.

Drill bits can have several nozzles. Nozzles can act as a conduit to hydraulically connect the tubular drill string with the annular space outside of the tubular drill string. Drilling fluid can be continuously pumped to circulate drilled cuttings out of the wellbore, to cool down the bit, and to provide hydraulic energy to aid in the rock cutting and removal process. Surface pumps can be used for pumping the drilling fluid from surface tanks down the tubular, through the bit nozzles to the tubing annuls, and back to the surface tanks. The nozzles are sized, shaped, and positioned depending on the hydraulic energy requirements, the pressure losses through the tubular and annulus, the drilling fluid specific gravity and weight, the depth of drilling, and the pressure capacity of rig equipment. Nozzles are also appropriately oriented to ensure efficient cleaning of cuttings at the bottom of the hole.

SUMMARY OF THE DISCLOSURE

In currently available drill bits, once the nozzles are installed, the nozzle area remains fixed until the drill bit is pulled out of the wellbore and the nozzles can be changed. Otherwise, the bit and nozzle configuration will define the total flow area of the drill bit, which is the collective flow area of all the nozzles installed in the drill bit. In currently available systems, the total flow area remains the same throughout the run of the drill string in the well.

As the well depth increases, the frictional forces on the fluid flow inside the tubular and in the annulus increase. This increase in frictional forces increases the pressure on the surface pumps. As the length of the tubular drill string increases, the pressure loss can increase significantly towards the end of the section. This increase in pressure loss would require higher pressure generated by the surface pump.

Once the pumping pressure reaches the pump operating limit, the pump rate needs to be reduced. Reducing the pumping rate reduces the friction pressure loss, and will eventually reduce the pumping pressure. Reducing the pumping rate will, however, reduce the annular velocity of the drilling fluid. A minimum annular velocity is needed for lifting cuttings and circulating the cuttings out of the wellbore. Reducing the pump rate reduces the downhole annular velocity of the drilling fluid, which reduces the wellbore cleaning efficiency.

Improper wellbore cleaning could lead to the accumulation of drill cuttings in the annulus and to the increased risk of the drill string to get stuck, jeopardizing the safety of the well. Reduced wellbore cleaning efficiency also necessitates controlling the drilling rate so that the rate of generation of the cuttings is reduced, which in turn reduces the drilling efficiency and increases the cost of drilling.

Embodiments of this disclosure provide systems and methods for changing the total flow area of a drill bit while the drill bit remains downhole. Systems and methods of this disclosure provide the option of activating additional nozzles downhole, which are already part of the drill bit, but are not in use. Opening an additional flow path can reduce the pressure drop across the drill bit while still maintaining hydraulic benefits of an appropriately designed size and shape of the nozzle. This will allow for maintaining a high pump rate and for the continuation of drilling without an increased risk of the accumulation of cuttings in the annulus.

In embodiments of the current application, one or more blocked nozzles will be embedded inside the body of the bit. One end of the nozzle will be directed towards the tubular and the other end will be directed towards the tubular annulus. Both ends of the blocked nozzle are covered with a disk that will isolate the nozzle during drilling operations.

When the pump pressure becomes a limiting factor, requiring a reduction of pressure loss, the discs blocking the two ends of the nozzle can be removed. As an example, the disks can be shattered or melted. Removing the disks will open up an additional passageway for the fluid flow through the drill bit and will reduce the pump pressures, which will allow for an increased flow rate for achieving optimum wellbore cleaning. The fragments of the disk will be flushed to the annulus through the nozzle.

In an embodiment of this disclosure, a system for drilling a subterranean well with a drill bit includes a drill bit body with a shank end and a nose end opposite the shank end. The drill bit body has a central bore with an open side at the shank end of the drill bit body, and with a closed side at the nose end of the drill bit body. Cutting members extend outward from the drill bit body. Cutters are located on the cutting members and oriented to remove subterranean material to form the subterranean well. A plurality of ports extend through the nose end of the drill bit body from the central bore to an outside of the drill bit body. A blocked nozzle is located within one of the plurality of ports. The blocked nozzle has a nozzle bore end and a nozzle nose end opposite the nozzle bore end. A bore end disk is located at the nozzle bore end of the blocked nozzle. The bore end disk extends across a cross sectional area of the blocked nozzle, preventing a flow of fluids through the blocked nozzle past the bore end disk. A nose end disk is located at the nozzle nose end of the blocked nozzle. The nose end disk extends across the cross sectional area of the blocked nozzle, preventing the flow of fluids through the blocked nozzle past the nose end disk. The nose end disk and the bore end disk are removable.

In alternate embodiments, a nose end groove can be located within the nozzle nose end of the blocked nozzle and the nose end disk can be located within the nose end groove. A bore end groove can be located within the nozzle bore end of the blocked nozzle, and the bore end disk can be located within the bore end groove.

In other alternate embodiments, the nose end disk and the bore end disk can each include a core formed of a removable material. The core can be a disk shaped member having a core outer diameter smaller than an inner diameter of the blocked nozzle. The nose end disk and the bore end disk can each include a rim member formed of a pliable material. The rim member can circumscribe and be secured to the core such that the rim member and the core are bonded together. The rim can have a rim outer diameter that is larger than the inner diameter of the blocked nozzle. An open nozzle can be located within one other of the plurality of ports. The open nozzle can be free of the nose end disk and the bore end disk.

In an alternate embodiment of this disclosure, a system for drilling a subterranean well with a drill bit includes a drill bit body with a shank end and a nose end opposite the shank end. The drill bit body has a central bore with an open side at the shank end of the drill bit body and with a closed side at the nose end of the drill bit body. A drill string is secured to the shank end of the drill bit body. The drill string has a drill string bore in fluid communication with the central bore of the drill bit body. A plurality of ports extend through the nose end of the drill bit body from the central bore to an outside of the drill bit body. The plurality of ports provide a fluid flow path between the drill string bore and an annulus defined between an outer diameter surface of the drill string and an inner diameter surface of a wellbore of the subterranean well. A blocked nozzle is located within one of the plurality of ports. The blocked nozzle has a nozzle bore end and a nozzle nose end opposite the nozzle bore end. A bore end disk is located at the nozzle bore end of the blocked nozzle. The bore end disk extends across a cross sectional area of the blocked nozzle, preventing a flow of fluids through the blocked nozzle past the bore end disk. A nose end disk is located at the nozzle nose end of the blocked nozzle. The nose end disk extends across the cross sectional area of the blocked nozzle, preventing the flow of fluids through the blocked nozzle past the nose end disk. The nose end disk and the bore end disk are removable.

In alternate embodiments, a nose end groove can be located within the nozzle nose end of the blocked nozzle and the nose end disk can be located within the nose end groove. A bore end groove can be located within the nozzle bore end of the blocked nozzle and the bore end disk can be located within the bore end groove. The nose end disk and the bore end disk can each include a core formed of a removable material. The core can be a disk shaped member having a core outer diameter smaller than an inner diameter of the blocked nozzle. The nose end disk and the bore end disk can each also include a rim member formed of a pliable material. The rim member can circumscribe and be secured to the core such that the rim member and the core are bonded together. The rim member can have a rim outer diameter that is larger than the inner diameter of the blocked nozzle.

In other alternate embodiments, an open nozzle can be located within one other of the plurality of ports. The open nozzle can be free of the nose end disk and the bore end disk. A surface pump can be operable to pump a drilling fluid in a downhole direction within the drill string bore and through certain of the plurality of ports with a required volume flow rate by removing the nose end disk and the bore end disk of the blocked nozzle.

In another alternate embodiment of this disclosure, a method for drilling a subterranean well with a drill bit includes providing the drill bit having a drill bit body with a shank end and a nose end opposite the shank end. The drill bit body has a central bore with an open side at the shank end of the drill bit body, and with a closed side at the nose end of the drill bit body. Cutting members extend outward from the drill bit body. Cutters are located on the cutting members and are oriented to remove subterranean material to form the subterranean well. A plurality of ports extend through the nose end of the drill bit body from the central bore to an outside of the drill bit body. A blocked nozzle is located within one of the plurality of ports. The blocked nozzle has a nozzle bore end and a nozzle nose end opposite the nozzle bore end. A bore end disk is located at the nozzle bore end of the blocked nozzle. The bore end disk extends across a cross sectional area of the blocked nozzle, preventing a flow of fluids through the blocked nozzle past the bore end disk. A nose end disk is located at the nozzle nose end of the blocked nozzle. The nose end disk extends across the cross sectional area of the blocked nozzle, preventing the flow of fluids through the blocked nozzle past the nose end disk. The nose end disk and the bore end disk are removable.

In alternate embodiments, locating the bore end disk at the nozzle bore end of the blocked nozzle can include locating the bore end disk within a bore end groove located within the nozzle bore end of the blocked nozzle. Locating the nose end disk at the nozzle nose end of the blocked nozzle can include locating the nose end disk within a nose end groove located within the nozzle nose end of the blocked nozzle. The nose end disk can include a core formed of a removable material. The core can be a disk shaped member having a core outer diameter smaller than an inner diameter of the blocked nozzle. The nose end disk can include a rim member formed of a pliable material. The rim member can circumscribe and be secured to the core such that the rim member and the core are bonded together. The rim member can have a rim outer diameter that is fractionally larger than the inner diameter of the port of the blocked nozzle. The method can further include pushing the nose end disk to fit into a groove of the port of the blocked nozzle, deforming the pliable material of the rim.

In other alternate embodiments, the bore end disk can include a core formed of a removable material. The core can be a disk shaped member having a core outer diameter smaller than an inner diameter of the blocked nozzle. The bore end disk can include a rim member formed of a pliable material. The rim member can circumscribe and be secured to the core such that the rim member and the core are bonded together. The rim can have a rim outer diameter that is fractionally larger than the inner diameter of the port of the blocked nozzle. The method can further include pushing the bore end disk to fit into a groove of the port of the blocked nozzle, deforming the pliable material of the rim.

In yet other alternate embodiments, the drill bit can be secured to a drill string. The drill string can have a drill string bore in fluid communication with the central bore of the drill bit body. The plurality of ports can provide a fluid flow path between the drill string bore and an annulus defined between an outer diameter surface of the drill string and an inner diameter surface of a wellbore of the subterranean well. The method can further include delivering a drilling fluid in a direction downhole within the drill string bore, through the plurality of ports, and in a direction uphole within the annulus.

In still other alternate embodiments, a surface pump can be operable to pump the drilling fluid in a downhole direction within the drill string bore and through certain of the plurality of ports with a required volume flow rate by removing the nose end disk and the bore end disk of the blocked nozzle. An open nozzle can be located within one other of the plurality of ports. The open nozzle can be free of the nose end disk and the bore end disk. The method can further include delivering a drilling fluid through the open nozzle. The nose end disk and the bore end disk can be removed from the blocked nozzle.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
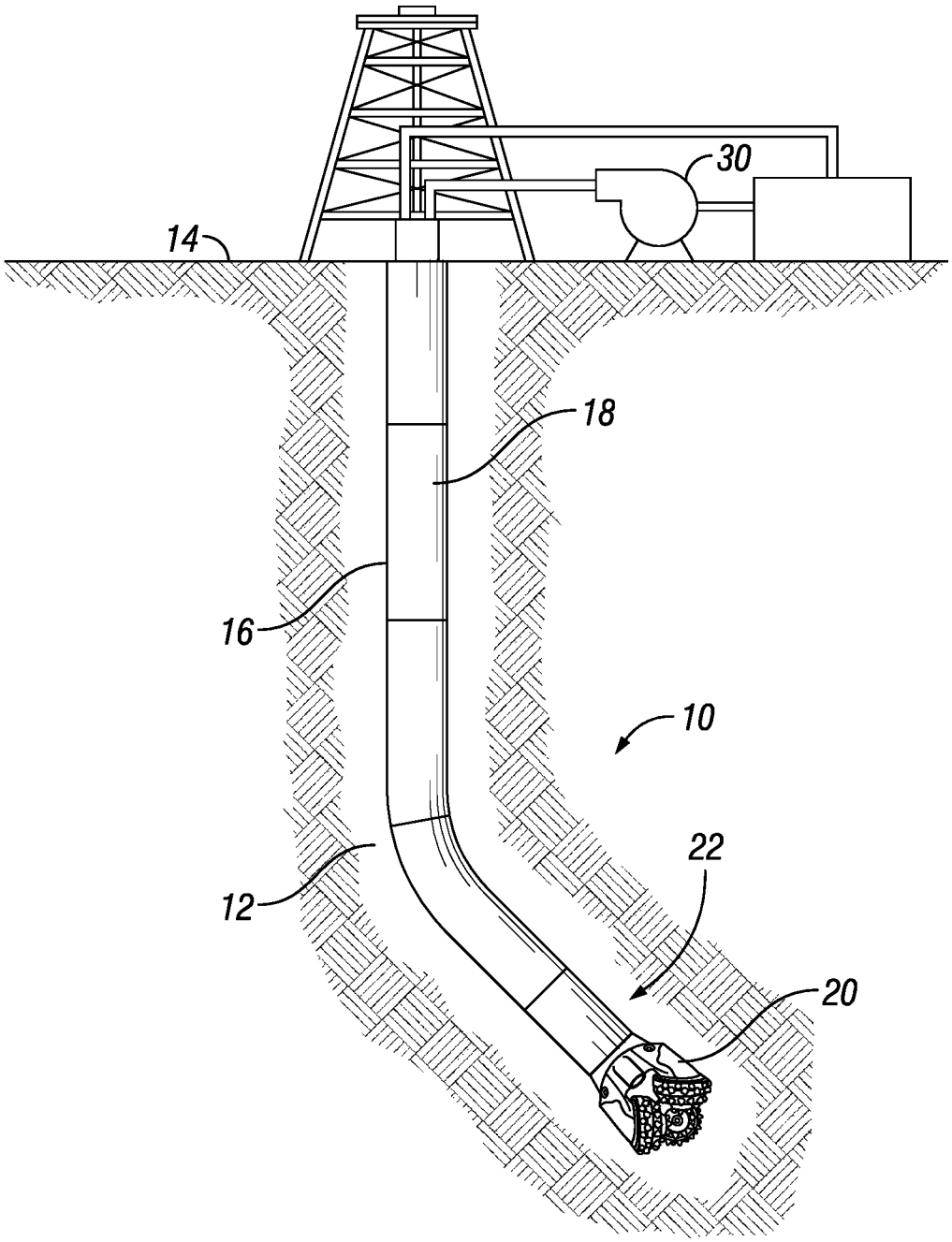
FIG. 1 is a section view of a subterranean well including a drill bit used for drilling the subterranean well, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Alternately, subterranean well 10 can be a water well, injection well, disposal well, test well, observation well, or other known type of subterranean well.

Drill string 16 can be delivered into and located within wellbore 12. Drill string 16 can include tubular member 18, drill bit 20, and bottom hole assembly 22. Bottom hole assembly 22 can include various components used to fulfill the drilling objectives. Bottom hole assembly 22 is located in-line between drill bit 20 and joints of tubular member 18. Tubular member 18 is connected to surface equipment on a drilling rig. Drill string 16 and bottom hole assembly 22 transfer the required mechanical and hydraulic energy from surface equipment to drill bit 20. Wellbore 12 can be drilled from surface 14 and into and through various formation zones of subterranean formations by rotation of drill bit 20.

Figure 2:
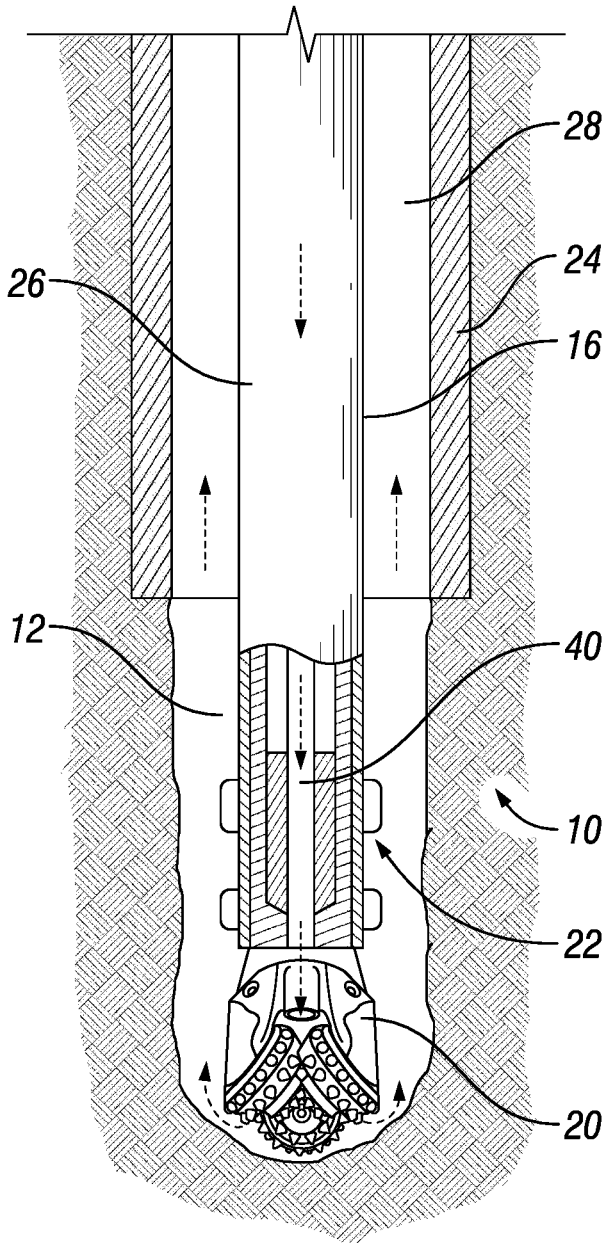
FIG. 2 is a section view of a downhole portion of a subterranean well including a drill bit used for drilling the subterranean well, in accordance with an embodiment of this disclosure.

Looking at FIG. 2, drill string 16 can extend through casing 24 of subterranean well 10. Casing 24 can be set at predetermined depth and cemented to isolate the formations drilled to that depth. Casing 24 ensures that continued drilling of wellbore 12 below casing 24 will not be impacted by the characteristics of any formations drilled in previous part of subterranean well 10, which are isolated by casing 24.

Drill bit 20 can be used to drill wellbore 12 to a deeper depth downhole of casing 24. Wellbore 12 downhole of casing 24 is an open hole wellbore. During drilling operations, drilling fluid can be delivered in a direction downhole within drill string bore 26, through ports of drill bit 20, and in a direction uphole within annulus 28. Annulus 28 is defined between an outer diameter surface of drill string 16 and an inner diameter surface of wellbore 12 or casing 24, as applicable.

As the drilling fluid travels downhole within drill string bore 26, through ports of drill bit 20, and uphole within annulus 28, the drilling fluid faces friction from the inner walls of drill string 16, through the bit nozzles, and from the walls of the wellbore 12 and casing 24. In addition, the drilling fluid also is subjected to frictional pressure losses in the surface equipment. Surface pump 30 (FIG. 1) is required to generate sufficient force to overcome aggregate friction forces.

Pump pressure is a function of surface equipment pressure loss, the length and the size of the components of drill string 16, the bit nozzle flow area, the size of the wellbore 12, size of casing 24, the mud specific gravity, the depth of drilling, the flow rate, and features of other tools and equipment through which the drilling fluid passes. As an example, as the depth of wellbore 12 increases, the frictional pressure loss also increases, which eventually increases pump pressure.

Figure 3:
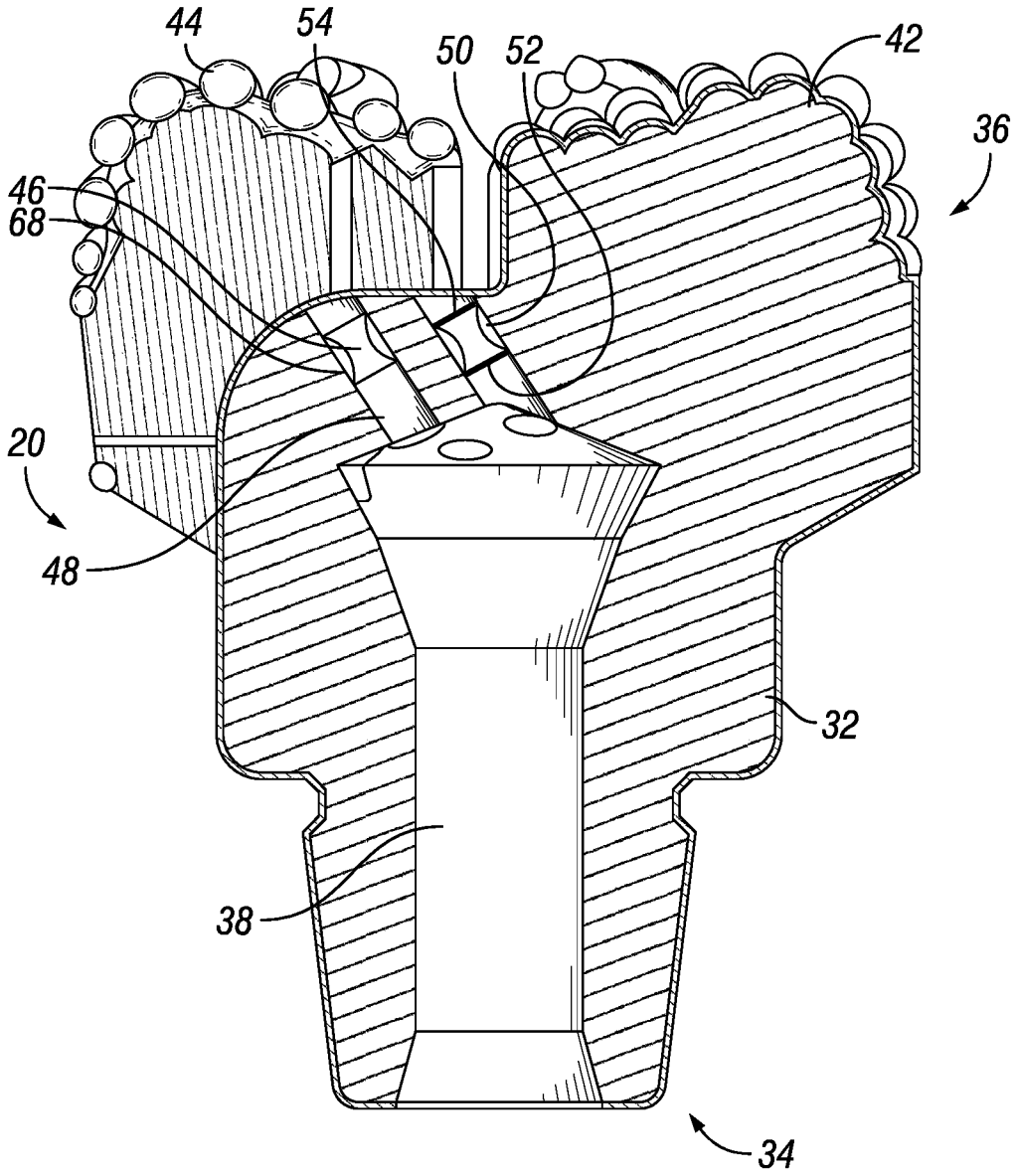
FIG. 3 is a section view of a drill bit with nozzles, in accordance with an embodiment of this disclosure.

Looking at FIG. 3, in an example embodiment, drill bit 20 can include drill bit body 32 with cutting members 42. In the example embodiment of FIG. 3, drill bit body 32 is shown as being formed of a single molded member that is shaped with the cutting members being a number of blades. Drill bit 20 can alternately have roller cones or combination of blades and roller cones. Drill bit body 32 can have shank end 34 and nose end 36 that is opposite shank end 34. Shank end 34 can be secured to drill string 16. As an example, shank end 34 of drill bit 20 can have threads that engage threads of a joint of tubular member 18 or bottom hole assembly 22 (FIG. 2).

Drill bit body 32 can include central bore 38. Central bore 38 is open at shank end 34 so that central bore 38 can be in fluid communication with drill string bore 40 (FIG. 2) of drill string 16. Central bore 38 has a closed side at nose end 36 of drill bit body 32 such that central bore 38 does not extend through nose end 36 of drill bit body 32.

Cutting members 42 can extend outward from drill bit body 32. Cutting members 42 can be located at nose end 36 of drill bit body 32. Cutters 44 can be located on cutting members 42 of drill bit 20 (FIG. 2). Cutters 44 can have a generally cylindrical shape and be symmetrical about a central axis, but can have other shapes as well depending on drill bit and cutter design. Cutters 44 are oriented to remove subterranean material to form subterranean well 10 (FIG. 1). Cutters 44 are configured to face in a direction so that as drill bit 20 rotates, a forward end of each cutter 44 can engage the earth or formation and cut, shear, or fracture the earth and rock formations to drill wellbore 12 and form subterranean well 10 (FIG. 1).

In the example embodiment of FIG. 3, drill bit 20 is a polycrystalline diamond compact type drill bit. In alternate embodiments, drill bit 20 can be a roller cone bit, a diamond impregnated bit, or other known bit used for drilling subterranean wells that have nozzles.

A nozzle 46 is installed within port 48. Drill bit 20 can include a plurality of ports 48 that extend through nose end 36 of drill bit body 32. Port 48 can extend from central bore 38 to an outside of drill bit body 32. Port 48 can provide a fluid flow path between drill string bore 40 and annulus 28 (FIG. 2). Each port 48 can have a nozzle 46.

Nozzle 46 is installed within port 48 to direct the flow of fluid through nozzle 46 during drilling operations when drill bit 20 is in the bottom of wellbore 12 (FIG. 1), or for fluid circulation activities when drill bit 20 is off the bottom of wellbore 12 (FIG. 1). Nozzles 46 are designed to provide a venturi effect to achieve a fluid velocity and impact force that will assist in the drilling process and in the cleaning and removal of drilled rock cuttings from within wellbore 12 (FIG. 1).

Subterranean formations have varying responses to hydraulic hose power. Softer formations may erode more by hydraulic force than harder formations, which typically require higher mechanical forces. Bottom hydraulic horse power is dependent on the pressure drop across nozzles 46. The smaller the nozzle cross sectional area, the higher the pressure drop will be. A higher hydraulic horsepower might be helpful while drilling shallower formations. However, as the drilling gets deeper and if formations become harder, the benefits of a higher hydraulic horse power diminish. At such a depth a higher pressure drop across drill bit 20 may not be needed.

Certain ports 48 can include blocked nozzle 50. Blocked nozzle 50 includes nozzle bore end 52. Blocked nozzle 50 further includes nozzle nose end 54 that is opposite nozzle bore end 52. Nozzle bore end 52 is closer to central bore 38 of drill bit body 32 than nozzle nose end 54 is to central bore 38 of drill bit body 32. Nozzle bore end 52 points towards central bore 38 and nozzle nose end 54 points towards annulus 28.

Figure 4:
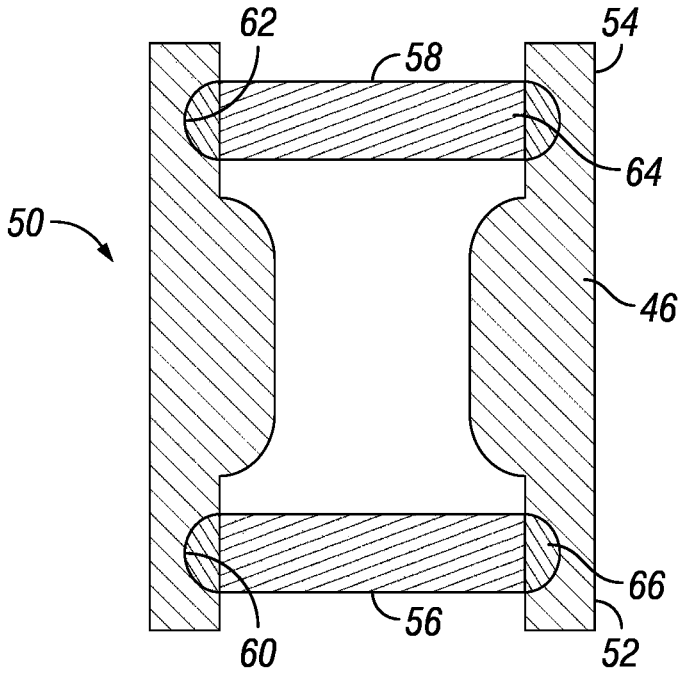
FIG. 4 is a schematic section view of a blocked nozzle, in accordance with an embodiment of this disclosure.

Looking at FIG. 4, an end disk is located at each end of blocked nozzle 50. Bore end disk 56 is located at nozzle bore end 52 of blocked nozzle 50. Bore end disk 56 extends across a cross sectional area of blocked nozzle 50, preventing a flow of fluids through blocked nozzle 50 past bore end disk 56. Nose end disk 58 is located at nozzle nose end 54 of blocked nozzle 50. Nose end disk 58 extends across the cross sectional area of blocked nozzle 50, preventing the flow of fluids through blocked nozzle 50 past nose end disk 58. Both nose end disk 58 and bore end disk 56 are removable.

In the example embodiment of FIG. 4, each of the end disks are located within a groove that circumscribes an inner diameter of blocked nozzle 50. Bore end groove 60 is located within an inner diameter of blocked nozzle 50 at nozzle bore end 52 of blocked nozzle 50. Bore end disk 56 is located within bore end groove 60. Nose end groove 62 is located within an inner diameter of blocked nozzle 50 at nozzle nose end 54 of blocked nozzle 50. Nose end disk 58 is located within nose end groove 62.

Figure 5:
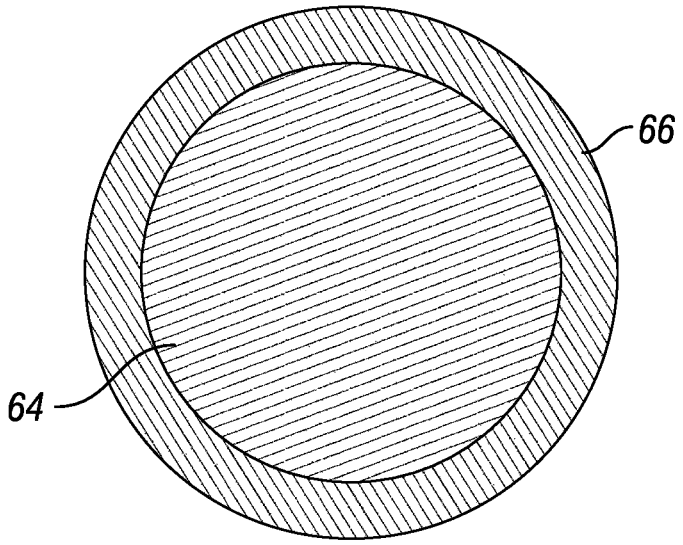
FIG. 5 is a cross sectional view of an end disk of a blocked nozzle, in accordance with an embodiment of this disclosure.

Each end disk is formed of a central core and an outer rim. Looking at FIG. 5, each nose end disk 58 and bore end disk 56 include core 64. Core 64 has a core outer diameter smaller than an inner diameter of blocked nozzle 50. Core 64 is a disk shaped member formed of a removable material.

The material used to form core 64 can be selected based on the mechanism that will be used to remove the end disk. As an example, an end disk can be shattered or melted. If the end disk is to be shattered with an applied pressure, then core 64 can be formed of a brittle glass or a brittle metalloid like silicon, boron, tellurium or other materials with similar brittle properties. Thickness of the end disc will vary with breaking pressure requirement. If the end disk is to be removed by melting the end disk with an elevated temperature, then core 64 can include a catalyst layer that generates a localized exothermic reaction upon spotting a designed chemical pill that raises the temperature locally to the threshold at which the material of the disc is designed to melt away. As an example, if the disc is coated with potassium permanganate ($KMnO4$) and a pill of glycerin is spotted across the disc, the reaction of the pill of glycerin will be an exothermic reaction, which will raise the temperature locally to melt the metal of the disc. Alternate combinations of chemicals that are suitable to drilling fluid properties and that can start an exothermic reaction sufficient to reach temperatures of the melting point of the metal used for the disc can be used.

In alternate example embodiments, core 64 can be removed with alternate mechanisms such as a flow rate of the drilling fluid, an electrical signal, an acoustic signal, an electromagnetic wave, a predetermined slack off weight, or a radio-frequency identification chip. Each such mechanism can use a sensor to measure the intended parameters and to trigger the failure mechanisms for the end disk to break.

Bore end disk 56 and nose end disk 58 of one of the blocked nozzles 50 can be designed to break at the same time or within a narrow predetermined span of time. In embodiments where there are more than one blocked nozzle 50, bore end disk 56 and nose end disk 58 of different blocked nozzles 50 can be designed to break by different mechanisms or at different threshold parameters of the same mechanism. Breaking the bore end disk 56 and nose end disk 58 of different blocked nozzles 50 at different times allows for the reduction of the pressure drop to be managed in stages, as needed, as downhole operations continue.

The end disks can include rim member 66. Rim member 66 circumscribes core 64 and is secured to core 64. Rim member 66 can be formed of a flexible material such as an elastic or a ductile material and can be bonded to core 64. Rim member 66 can have a rim outer diameter that is larger than the inner diameter of blocked nozzle 50. Rim member 66 can be bonded to core 64 either through pressure weld or adhesive weld such that the bond strength is greater than the core failure strength.

Looking at FIG. 4, rim member 66 can have sufficient flexibility to bend or deform so that bore end disk 56 and nose end disk 58 can be pushed or pressed into blocked nozzle 50 to be located within bore end groove 60 and nose end groove 62, respectively. Rim member 66 can have sufficient stiffness so that bore end disk 56 and nose end disk 58 will be retained within bore end groove 60 and nose end groove 62, respectively during drilling operations. Rim member 66 can be made up of a pliable material. As an example, rim member 66 can be formed of a flexible material like rubber or malleable metals such as copper, depending on the force required to insert the disc into the groove and expected operating temperature.

Each of the end disks can remain within their respective groove while fluids are being circulated through drill string 16. The end disks will remain within their respective groove during normal drilling operations, and will be removed only when an explicit action is undertaken. As an example, the end disks are formed of a material that is able to withstand the fluid pressures, temperatures, and fluid properties associated with drilling operations without breaking, melting, corroding, or eroding.

When flow through additional nozzles is desirable, an action can be taken to remove both bore end disk 56 and nose end disk 58 from blocked nozzle 50. After the removal of bore end disk 56 and nose end disk 58 from blocked nozzle 50, drilling fluid which was previously prevented from passing through blocked nozzle 50 can then travel through blocked nozzle 50.

Figure 6:
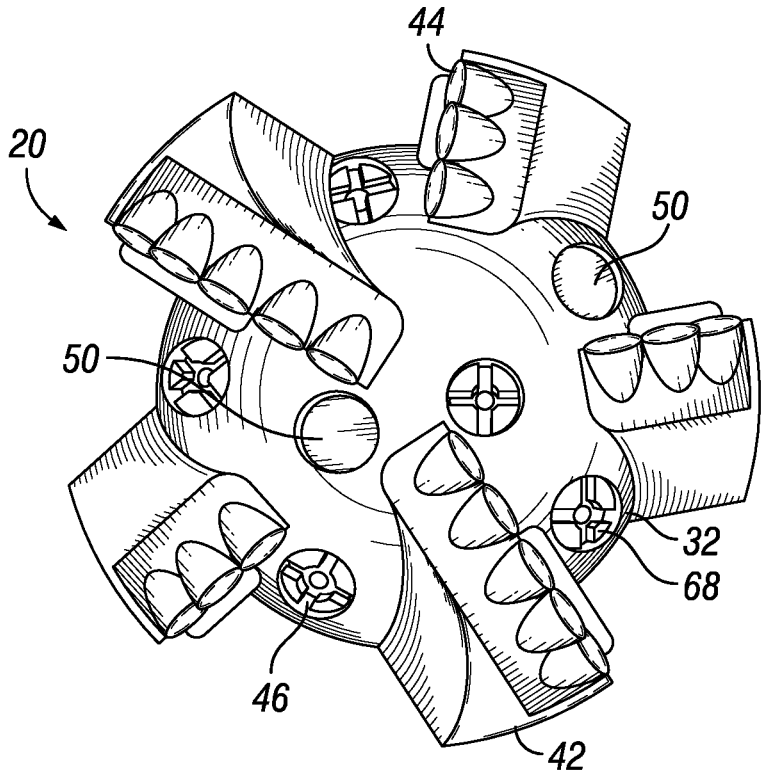
FIG. 6 is a perspective end view of a drill bit with nozzles, in accordance with an embodiment of this disclosure, shown with an end disk located in a blocked nozzle.

Looking at FIG. 6, drill bit 20 can include a number of nozzles 68 open to fluid flow. Nozzle 68 is located within port 48 (FIG. 3). Nozzle 68 is free of any end disks, including being free of bore end disk 56 and nose end disk 58. Fluid can flow through nozzle 68 for the duration of the well development operations. As an example, drilling fluid can flow through each nozzle 68 from the commencement of drilling operations. In the example embodiment of FIG. 6, there are five nozzles 68 that are open to fluid flow. In alternate embodiments, there can be four or fewer than five open nozzles 68. In other alternate embodiments, there can be six or more than six open nozzles 68.

Other of the ports 48 can include blocked nozzle 50. In the example embodiment of FIG. 6, there are two blocked nozzles 50 located within ports 48. When drill bit 20 is run into wellbore 12, a blocked nozzle 50 will prevent the flow of fluid through any port 48 that contains blocked nozzle 50.

Figure 7:
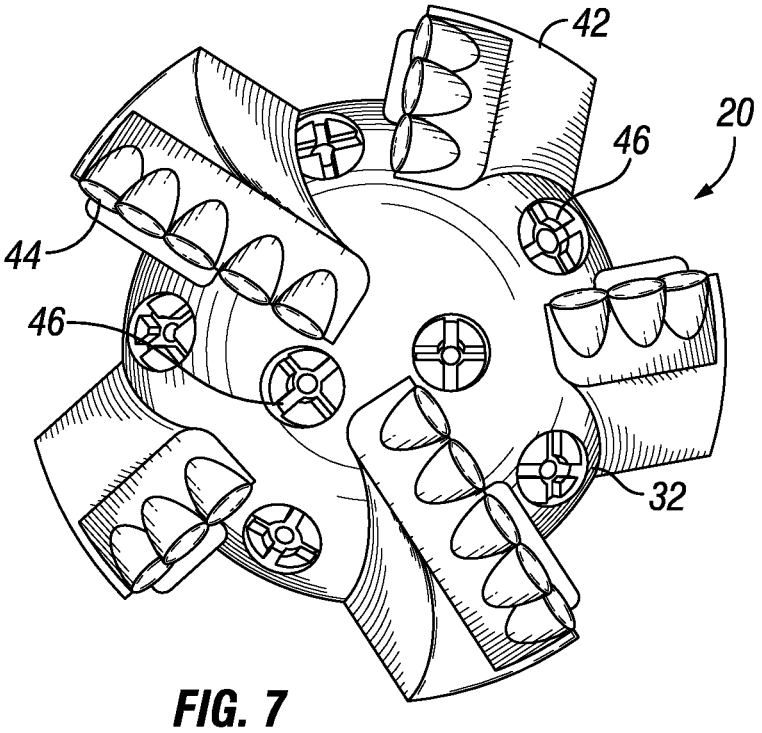
FIG. 7 is a perspective end view of the drill bit of FIG. 6, shown with the end disk removed from a blocked nozzle.

Looking at FIG. 7, when an increase in total flow area of drill bit 20 is desired, both bore end disk 56 and nose end disk 58 of both of the blocked nozzle 50 can be removed. Drill bit 20 would then have two additional nozzles 46, for a total of seven nozzles. The addition of the two extra nozzles 46 will relieve pressure on surface pump 30 (FIG. 1), which can allow the drilling operations to continue without the need to reduce the pump rate. Reducing the pump rate would increase the risk of cuttings accumulating in wellbore 12.

In an example of operation, in order to drill wellbore 12 of subterranean well 10, drill bit 20 can be secured to drill string 16. As drilling operations commence, drill bit 20 is rotated. Surface pump 30 is used to provide the fluid pressure required circulate the drilling fluid in a downhole direction through drill string 16, through open nozzles 68 of drill bit 20, and in an uphole direction through annulus 28.

As the drilling operations continue, the fluid pressure and the volume flow rate of the drilling fluid within wellbore 12 can be maintained at a required volume flow rate for performing the drilling operations. As an example, the volume flow rate of the drilling fluid within wellbore 12 can be maintained within a desired range by increasing the total flow area of drill bit 20 by removing bore end disk 56 and nose end disk 58 of blocked nozzle 50. The increase in the number of nozzles through which the drilling fluids can flow will reduce the pressure drop across drill bit 20, which will allow the maintenance of a high pump rate and for the continuation of drilling without an increased risk of the accumulation of cutting in annulus 28 and still maintain the drilling efficiency benefits of appropriately designed nozzle shape and sizes.

Embodiments of this disclosure therefore provide for the addition of nozzles within a drill bit during drilling operations without the need to pull the drill bit from the wellbore. By breaking disks that are blocking the nozzle, one or more previously concealed nozzles can be added to the drill bit to increase the flow area and reduce the pressure drop across the bit. Adding additional nozzles to the drill bit will improve the wellbore cleaning efficiency, reduce the strain on surface equipment, and provide flexibility in adjusting the total flow area at the bit without pulling the drill string or the drill bit.

Embodiments of this disclosure, therefore, are well adapted to carry out the objectives and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for drilling a subterranean well with a drill bit, the system including:

a drill bit body with a shank end and a nose end opposite the shank end, the drill bit body having a central bore with an open side at the shank end of the drill bit body and with a closed side at the nose end of the drill bit body;

cutting members extending outward from the drill bit body;

cutters located on the cutting members and oriented to remove subterranean material to form the subterranean well;

a plurality of ports extending through the nose end of the drill bit body from the central bore to an outside of the drill bit body;

a blocked nozzle located within one of the plurality of ports, the blocked nozzle having a nozzle bore end and a nozzle nose end opposite the nozzle bore end;

a bore end disk located at the nozzle bore end of the blocked nozzle, the bore end disk extending across a cross sectional area of the blocked nozzle, preventing a flow of fluids through the blocked nozzle past the bore end disk; and a nose end disk located at the nozzle nose end of the blocked nozzle, the nose end disk extending across the cross sectional area of the blocked nozzle, preventing the flow of fluids through the blocked nozzle past the nose end disk; where the nose end disk and the bore end disk are removable;

the nose end disk and the bore end disk each include a core formed of a removable material;

the nose end disk and the bore end disk each include a rim member formed of a different material than the core, the rim member formed of pliable material circumscribing and secured to the core such that the rim member and the core are bonded together.

2. The system of claim 1, further including:

a nose end groove located within the nozzle nose end of the blocked nozzle, where the nose end disk is located within the nose end groove; and a bore end groove located within the nozzle bore end of the blocked nozzle, where the bore end disk is located within the bore end groove; where the nose end groove and the bore end groove circumscribe an inner diameter surface of the blocked nozzle and the blocked nozzle comprises a single nozzle body.

3. The system of claim 1, where the core is a disk shaped member having a core outer diameter smaller than an inner diameter of the blocked nozzle.

4. The system of claim 3, where the rim has an outer diameter that is fractionally larger than the inner diameter of the blocked nozzle.

5. The system of claim 1, further including an open nozzle located within one other of the plurality of ports, the open nozzle being free of the nose end disk and the bore end disk.

6. A system for drilling a subterranean well with a drill bit, the system including:

a drill bit body with a shank end and a nose end opposite the shank end, the drill bit body having a central bore with an open side at the shank end of the drill bit body and with a closed side at the nose end of the drill bit body;

a drill string secured to the shank end of the drill bit body, the drill string having a drill string bore in fluid communication with the central bore of the drill bit body;

a plurality of ports extending through the nose end of the drill bit body from the central bore to an outside of the drill bit body, the plurality of ports providing a fluid flow path between the drill string bore and an annulus defined between an outer diameter surface of the drill string and an inner diameter surface of the wellbore of the subterranean well;

a blocked nozzle located within one of the plurality of ports, the blocked nozzle having a nozzle bore end and a nozzle nose end opposite the nozzle bore end;

a bore end disk located at the nozzle bore end of the blocked nozzle, the bore end disk extending across a cross sectional area of the blocked nozzle, preventing a flow of fluids through the blocked nozzle past the bore end disk;

a nose end disk located at the nozzle nose end of the blocked nozzle, the nose end disk extending across the cross sectional area of the blocked nozzle, preventing the flow of fluids through the blocked nozzle past the nose end disk;

a nose end groove located within the nozzle nose end of the blocked nozzle, where the nose end disk is located within the nose end groove;

a bore end groove located within the nozzle bore end of the blocked nozzle, where the bore end disk is located within the bore end groove; where the nose end groove and the bore end groove circumscribe an inner diameter surface of the blocked nozzle and the blocked nozzle is formed of a single nozzle body; and the nose end disk and the bore end disk are removable.

7. The system of claim 6, where the nose end disk and the bore end disk each include:

a core formed of a removable material, the core being a disk shaped member having a core outer diameter smaller than an inner diameter of the blocked nozzle; and a rim member formed of a pliable material that is different than the removable material, the rim member circumscribing and secured to the core such that the rim member and the core are bonded together, and having a rim outer diameter that is fractionally larger than the inner diameter of the blocked nozzle.

8. The system of claim 6, further including an open nozzle located within one other of the plurality of ports, the open nozzle being free of the nose end disk and the bore end disk.

9. The system of claim 6, further including a surface pump, the surface pump operable to pump a drilling fluid in a downhole direction within the drill string bore and through certain of the plurality of ports with a required volume flow rate by removing the nose end disk and the bore end disk of the blocked nozzle.

10. A method for drilling a subterranean well with a drill bit, the method including:

providing the drill bit having:

a drill bit body with a shank end and a nose end opposite the shank end, the drill bit body having a central bore with an open side at the shank end of the drill bit body and with a closed side at the nose end of the drill bit body;

cutting members extending outward from the drill bit body;

cutters located on the cutting members and oriented to remove subterranean material to form the subterranean well; and a plurality of ports extending through the nose end of the drill bit body from the central bore to an outside of the drill bit body;

locating a blocked nozzle within one of the plurality of ports, the blocked nozzle having a nozzle bore end and a nozzle nose end opposite the nozzle bore end, the blocked nozzle comprising a single nozzle body;

locating a bore end disk at the nozzle bore end of the blocked nozzle, the bore end disk extending across a cross sectional area of the blocked nozzle, preventing a flow of fluids through the blocked nozzle past the bore end disk;

locating a nose end disk at the nozzle nose end of the blocked nozzle, the nose end disk extending across the cross sectional area of the blocked nozzle, preventing the flow of fluids through the blocked nozzle past the nose end disk;

securing the drill bit to a drill string, the drill string having a drill string bore in fluid communication with the central bore of the drill bit body; and drilling the subterranean well with the drill bit; where the nose end disk and the bore end disk are removable;

the nose end disk and the bore end disk each include a core formed of a removable material;

the nose end disk and the bore end disk each include a rim member formed of a different material than the core, the rim member formed of pliable material circumscribing and secured to the core such that the rim member and the core are bonded together;

locating the bore end disk at the nozzle bore end of the blocked nozzle includes pressing the bore end disk through the nozzle bore end of the nozzle bore and into a bore end groove located within the nozzle bore end of the blocked nozzle; and locating the nose end disk at the nozzle nose end of the blocked nozzle includes pressing the nose end disk through the nozzle nose end of the nozzle bore and into a nose end groove located within the nozzle nose end of the blocked nozzle.

11. The method of claim 10, where:

the core is a disk shaped member having a core outer diameter smaller than an inner diameter of the blocked nozzle; and the rim member has a rim outer diameter that is fractionally larger than the inner diameter of the port of the blocked nozzle; where pressing the bore end disk through the nozzle bore end of the nozzle bore and into the bore end groove includes deforming the pliable material of the rim.

12. The method of claim 10, where:

the core is a disk shaped member having a core outer diameter smaller than an inner diameter of the blocked nozzle; and the rim member has a rim outer diameter that is fractionally larger than the inner diameter of the port of the blocked nozzle; where pressing the nose end disk through the nozzle nose end of the nozzle bore and into the nose end groove includes deforming the pliable material of the rim.

13. The method of claim 10, where the plurality of ports provide a fluid flow path between the drill string bore and an annulus defined between an outer diameter surface of the drill string and an inner diameter surface of a wellbore of the subterranean well, the method further including delivering a drilling fluid in a direction downhole within the drill string bore, through the plurality of ports, and in a direction uphole within the annulus.

14. The method of claim 13 further including a surface pump, the surface pump operable to pump the drilling fluid in the downhole direction within the drill string bore and through certain of the plurality of ports with a required volume flow rate by removing the nose end disk and the bore end disk of the blocked nozzle.

15. The method of claim 10, further including an open nozzle located within one other of the plurality of ports, the open nozzle being free of the nose end disk and the bore end disk, the method further including delivering a drilling fluid through the open nozzle.

16. The method of claim 10, further including removing the nose end disk and the bore end disk from the blocked nozzle.

* * * * *